United States Patent [19]

Kroger et al.

[11] 3,966,076

[45] June 29, 1976

[54] CONTACT LENS ACCESSORY CASE

[75] Inventors: Douglas J. Kroger; Donald J. Kroger, both of Lincoln, Nebr.; Winton D. Jensen, Leawood; Donald L. Rohrs, Overland Park, both of Kans.

[73] Assignee: Consolcase, Inc., Lincoln, Nebr.

[22] Filed: May 18, 1973

[21] Appl. No.: 361,832

[52] U.S. Cl. ..... 220/20; 190/51; 190/57; 206/5.1; 206/235; 220/4 B; 220/94 A; 220/339; 220/306

[51] Int. Cl.[2] ..... B65D 1/24

[58] Field of Search ..... 206/38, 235, 5, 5.1, 206/6; 190/51, 57, 41 R, 41 B; 220/4 B, 4 E, 20, 22, 31 S, 94 A; 217/7, 10, 19

[56] References Cited

UNITED STATES PATENTS

| | | | |
|---|---|---|---|
| 2,211,660 | 8/1940 | Kidd et al. | 190/51 |
| 3,294,270 | 12/1966 | Geisler | 217/21 |
| 3,359,411 | 12/1967 | Schwartz | 240/6.4 R |
| 3,497,041 | 2/1970 | Samhammer | 190/18 |
| 3,537,552 | 11/1970 | Noble | 190/51 |
| 3,563,482 | 2/1971 | Auld | 220/4 B |
| 3,565,305 | 2/1971 | Belokin, Jr. | 224/42.1 |
| D217,439 | 5/1970 | Platte | D9/44 |
| R25,530 | 3/1964 | King | 206/4 |

*Primary Examiner*—William Price
*Assistant Examiner*—Bruce H. Bernstein
*Attorney, Agent, or Firm*—Thomas M. Scofield

[57] ABSTRACT

A multi-compartmented carrying case; the case formed of a pair of substantially rectangular receptacles hinged at one end thereof to one another and having latch means at the other end thereof, at least one of the rectangular receptacles (and preferably both thereof) having a plurality of elongate partitions therein forming or defining in such said receptacle a plurality of substantially rectangular storage chambers; the depth of one of the receptacles typically less than the depth of the other receptacle; handle means integrally formed in the outer side wall of each of said receptacles cooperating in arrangement for grasping by the user and carrying and handling of same; means for receiving and fixedly retaining in position in the storage chambers of the said rectangular receptacles a plurality of containers or devices to be received in and transported by the case; the bottom walls of the paired rectangular receptacles formed so as to rest the case thereon in closed or open position, in the latter displaying the contents of the case for use; a multi-compartmented carrying case having a pair of receptacle sides each having a multiplicity of compartments therewithin, the case and compartmentation thereof particularly arranged and adapted to receive the means and accessories for maintaining contact lenses.

3 Claims, 18 Drawing Figures

CONTACT LENS ACCESSORY CASE

DESCRIPTION OF THE INVENTION

The subject multiple compartment carrying case is provided with two sets of compartments which are located with one set thereof on each inside surface of one side wall. The handle of the case is integrally built within the walls of the case and configured to be larger at the thumb gripping area. The two sides of the container overlap in closure whereby to provide the appearance of even or equal depth. Each one of the containers or devices received and confined within the compartments of the case is provided with retaining means. The entire case may be molded in one piece form from plastic with the bottle or container retainers hinged with a 270° arc into a snap fit. The case is further designed to open to a display for use and, as such, will stand by itself alone, open, by means of ribs on the underside of the case. The case also will stand stably when closed. There is further provided a two-sided (not the underside or the hinged side) overlap at the seam to give the appearance of a symmetrical structure although one set of compartments and sides is of lesser depth than the other. There is a sealing abutment along the bottom of the case where the retaining wall faces abut in closure. A hinge is provided at one vertical edge of the case and a snap fastener on the other vertical parallel edge.

An optimum specific application of the subject multicompartment carrying case lies in its adaptation to and use as a carrying case for accessories necessarily and optimally required for contact lenses. The following items are daily used by contact lens owners and generally are carried by the contact lens user in overnight travel if the contacts are to be used by him:

1. Contact lens soaking solution. This typically comes in a four fluid ounce container and is employed in an overnight contact lens storage case as a disinfectant of the lenses. This is preferably used daily.

2. A contact lens washing machine. This typically is a container with a lid through which extends a plunger with a handle outside the lid and double lens receptacles at the inside end of the plunger. The plunger is moved up and down through the lid, thus reciprocating the lens receptacles in the cleaning solution.

3. A water tray. This is for cleaning the lenses themselves and disinfecting same with the soaking solution previously mentioned. Typically, this tray has curved interior corners at each end for ready access to the lenses from the fluid therewithin.

4. A contact lens wetting solution which is applied to the lenses before application thereof to the user's eyes. The typical container for this (commercial) contains two fluid ounces.

5. Contact lens cleaner (may be concentrated). This may be used in the washing machine (number (2), supra) or the water tray (number (3), supra) and a container thereof typically is one or one-half fluid ounces.

6. Lens storage case. A typical form of this is a cylindrical, relatively small case having an individual receptacle for each lens, the receptacles vertically received in a cylindrical pop-up structure spring-loaded centrally of the storage case which has a screw-down cap. The fluid received in the storage case is typically number (1), supra, the contact lens soaking solution.

7. A typical eye decongestant. Commercially available containers may hold 15 cc of decongestant.

These noted solutions and accessory means and devices are not in themselves, per se, a part of or the invention herein described. In a specific preferred application of use of the inventive compartmented case, they are those elements, means and devices necessary and desired for maintenance and use of contact lenses by a wearer of same, in day to day use. As such, a carrying case for same, operative to receive, carry and dispense each, in ordered array, of minimal bulk, would be eminently desirable.

OBJECTS OF THE INVENTION

An object of the invention is to provide a contact lens accessory carrying case of unique and valuable construction and use, the case having two sets of a multiplicity of compartments, one set on the inside of each of two centrally hinged walls.

Another object of the invention is to provide such an improved contact lens accessory carrying case which is particularly and uniquely adapted to the compact and serviceably carrying, protecting and use of all necessary and desired elements for cleaning and servicing contact lenses, in day to day use.

Another object of the invention is to provide such an improved carrying case adapted to contain, transport and offer for use all of (1) a container of contact lens soaking solution, (2) a contact lens washing machine (including a water tray for cleaning the contact lenses), (3) a container of contact lens wetting solution, (4) a container of contact lens cleaner for used in the aforementioned lens washing machine and water tray, (5) a contact lens storage case, (6) a container of eye decongestant and (7) space for a glasses case.

Another object of the invention is to provide such an improved accessory carrying case providing separate and separated individual compartments therein for receiving and retaining, as noted, a multiplicity of necessary and desired contact lens accessory fluids and devices, the container integrally providing therewith a grasping and carrying zone in the outside wall thereof, providing for convenience of use and handling yet not constricting the necessary and required space within the case for receiving the previously noted elements.

Another object of the invention is to provide such a contact lens accessory, use and display case wherein the case itself opens to provide access to the separate and retained accessories, easily retaining itself on a flat surface in erect open position for ready access to the contents and return of same after use to the case.

Another object of the invention is to provide such a contact lens accessory carrying case which optionally and preferably may be injected molded of suitable plastic such as polypropylene, thereby to provide a durable, useful carrying case for a multiplicity of receptacles and items for servicing contact lenses, the case being two part and hinged at one edge of each part, one of said portions thereof of greater depth than the other whereby to handle larger items therein on one side thereof and vice versa.

Another object of the invention is to provide a novel, useful contact lens accessory carrying case which may receive and retain therewithin, optionally, a mini-case separately useable therefrom, as when a lady wishes to carry the mini-case in her pocketbook. (The mini-case includes, as bare essentials, a container of cleaner solution, a container of wetting solution, a storage case with a lens soaker therewithin and a mirror.)

Another object of the invention is to provide a multiple compartment carrying case with two sets of compartments therein, one on the inside of each of two centrally hinged walls, locking means provided to secure the case closed, the case particularly adapted to carrying all of the elements for cleaning and servicing contact lens, also utilizable to carry of chemicals, instruments, cosmetics, and the like, thereby providing a broad spectrum of uses.

Another object of the invention is to provide a multiple compartment carrying case having two sets of compartments, one on the inside of each of two centrally hinged walls, the case also having a handle built into the walls of the case, same so configured as to be larger in the thumb gripping area with the bottles, etc., in the compartments arranged so that the larger ones are in the smaller handle section and vice versa.

Another object of the invention is to provide an improved, multiple compartment carrying case having two separate sets of compartments, one set on the inside of each of two centrally hinged walls, there being provided a different number and spacing of compartments between the two sets, the case adapted to sit, when either closed or open, on a lower edge thereof, and opening around the hinge, thereby to present the two facing sets of compartments for display or for use with the articles carried therewithin in vertical position separately received each within its own compartment, thereby functioning equally well as a display case or dispensing container.

Another object is to provide an improved multi-compartment receiving, carrying, transporting, displaying and dispensing container which is easily and cheaply manufactured by simple plastic injection molding practices, has a long life, is rugged, adapted to many desirable uses and, as well, provides a unique closure construction giving the appearance of even or equal depth sides (although one side is of greater depth than the other) by virtue of an overlying flap closure construction on one of the sides on two walls thereof.

Other and further objects of the invention will appear in the course of the following description thereof.

DESCRIPTION OF THE DRAWINGS

In the drawings, which form a part of the instant specification and are to be read in conjunction therewith, an embodiment of the invention is shown, and, in the various views, like numerals are employed to indicate like parts.

MAIN ACCESSORY CASE DRAWINGS

Figure 1:
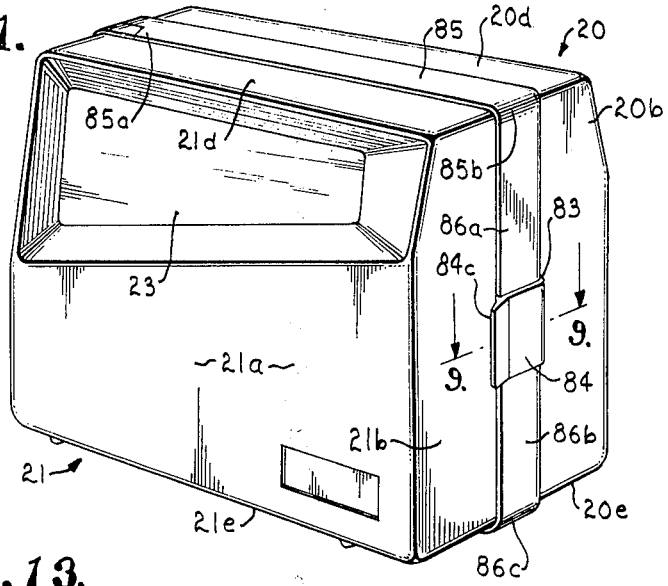

FIG. 1 is a three-quarter perspective view of the subject case from above and from the latching end (closed).

Figure 2:
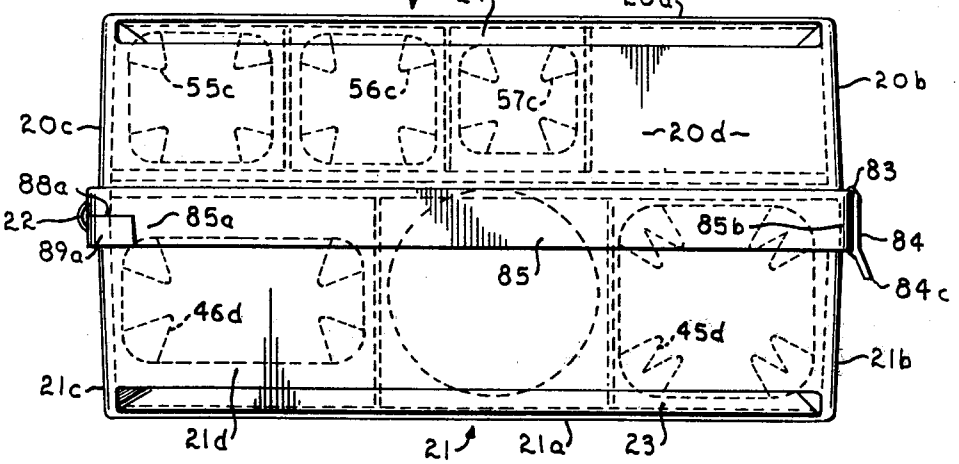

FIG. 2 is a top plan view of the device of FIG. 1 with the hinge end to the left in the view and the latch end to the right; the compartments of the two sides thereof (sides of both greater and lesser depth) shown in dotted lines (device shown closed).

Figure 3:
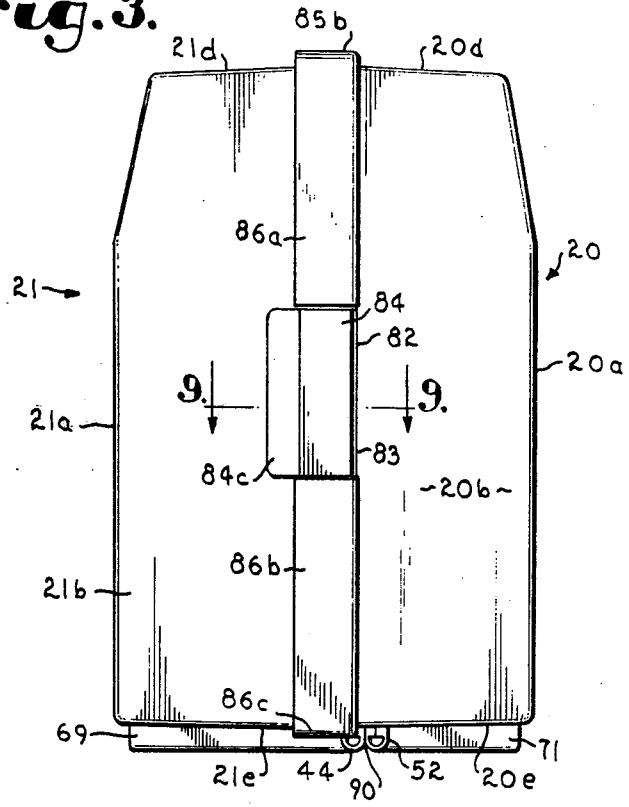

FIG. 3 is an end view of the case of FIG. 1 and 2 from the latch end (device closed).

Figure 4:
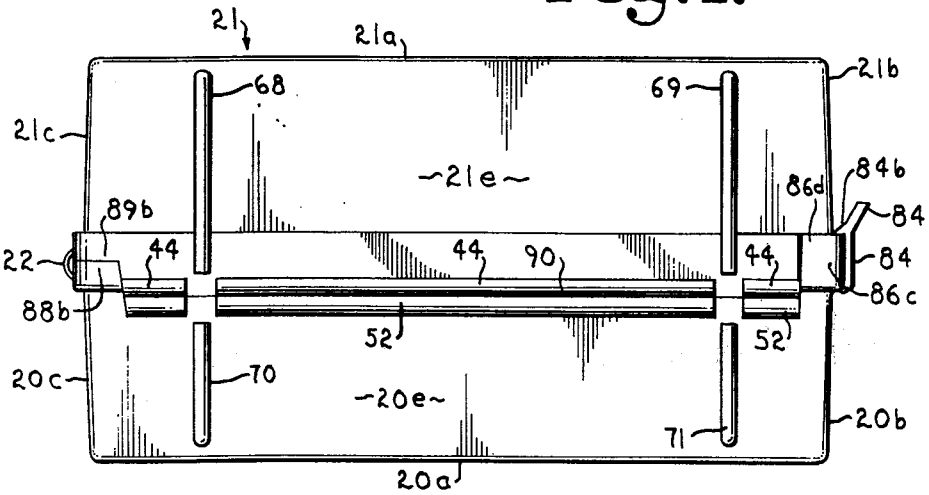

FIG. 4 is a bottom plan view of the device of FIG. 1–3, inclusive, with the hinge and latch at the left and right hand sides of the view, respectively (as in FIG. 2), the case shown in closed position.

Figure 5:
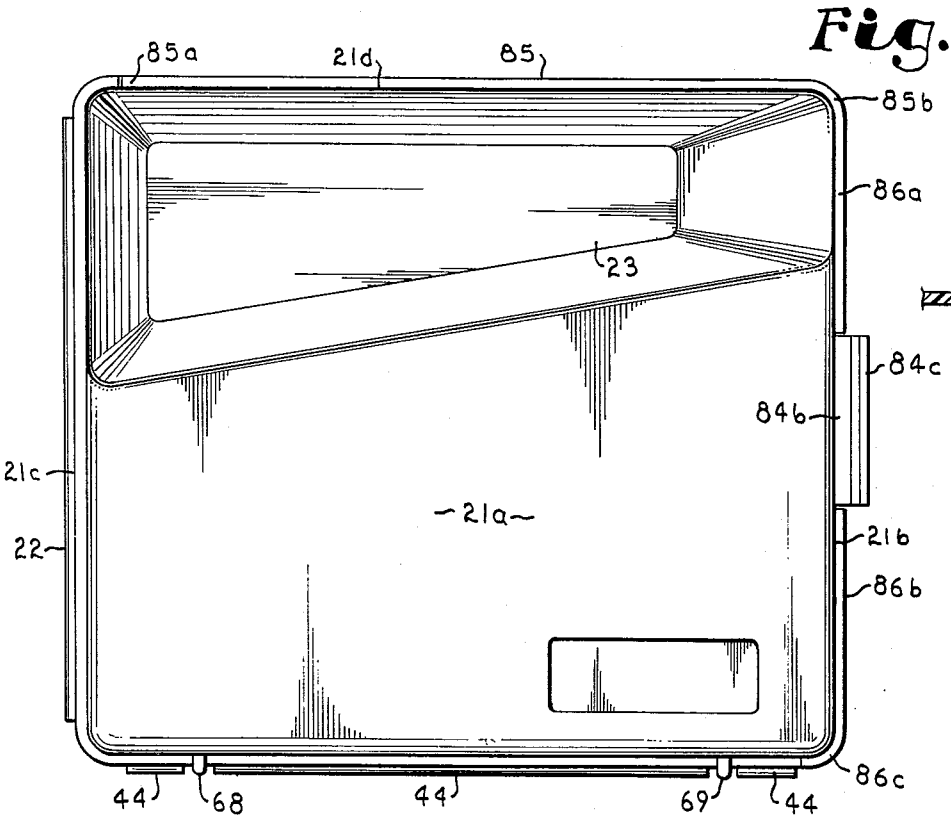

FIG. 5 is a side elevation of the subject device with the hinge and latch ends at the left and right sides of the view, respectively (as in FIGS. 2 and 4), (case shown closed).

Figure 6:
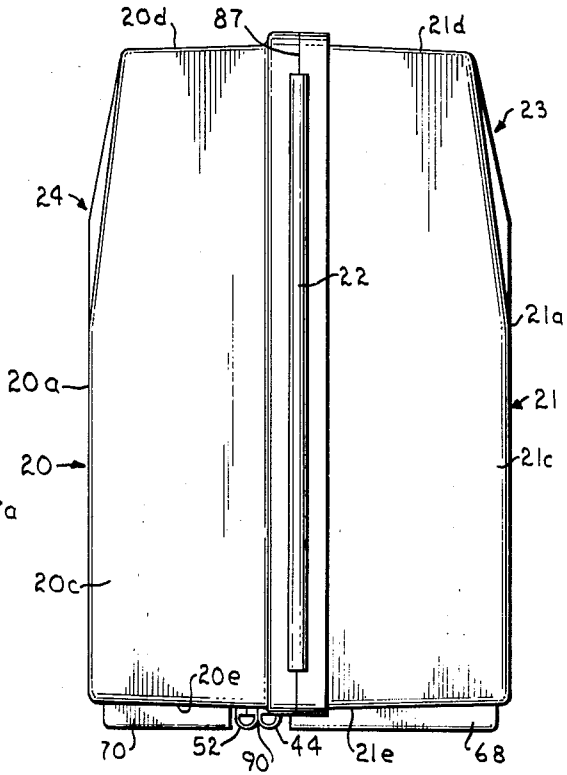

FIG. 6 is an end view of the case of FIGS. 1–5, inclusive from the hinge end (case shown closed).

Figure 7:
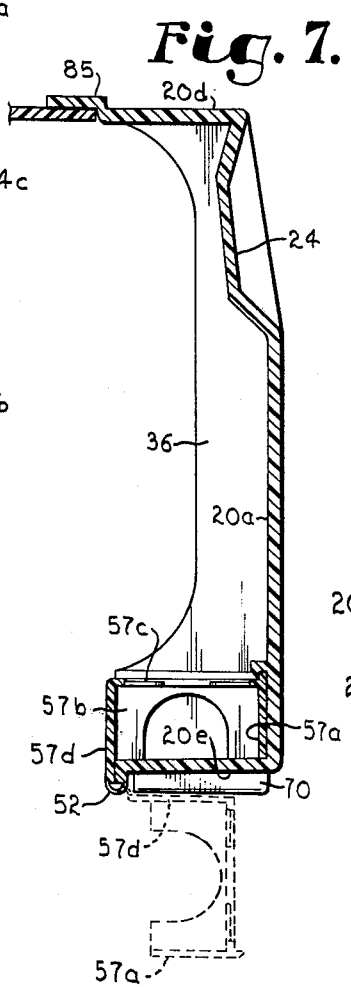
Figure 11:
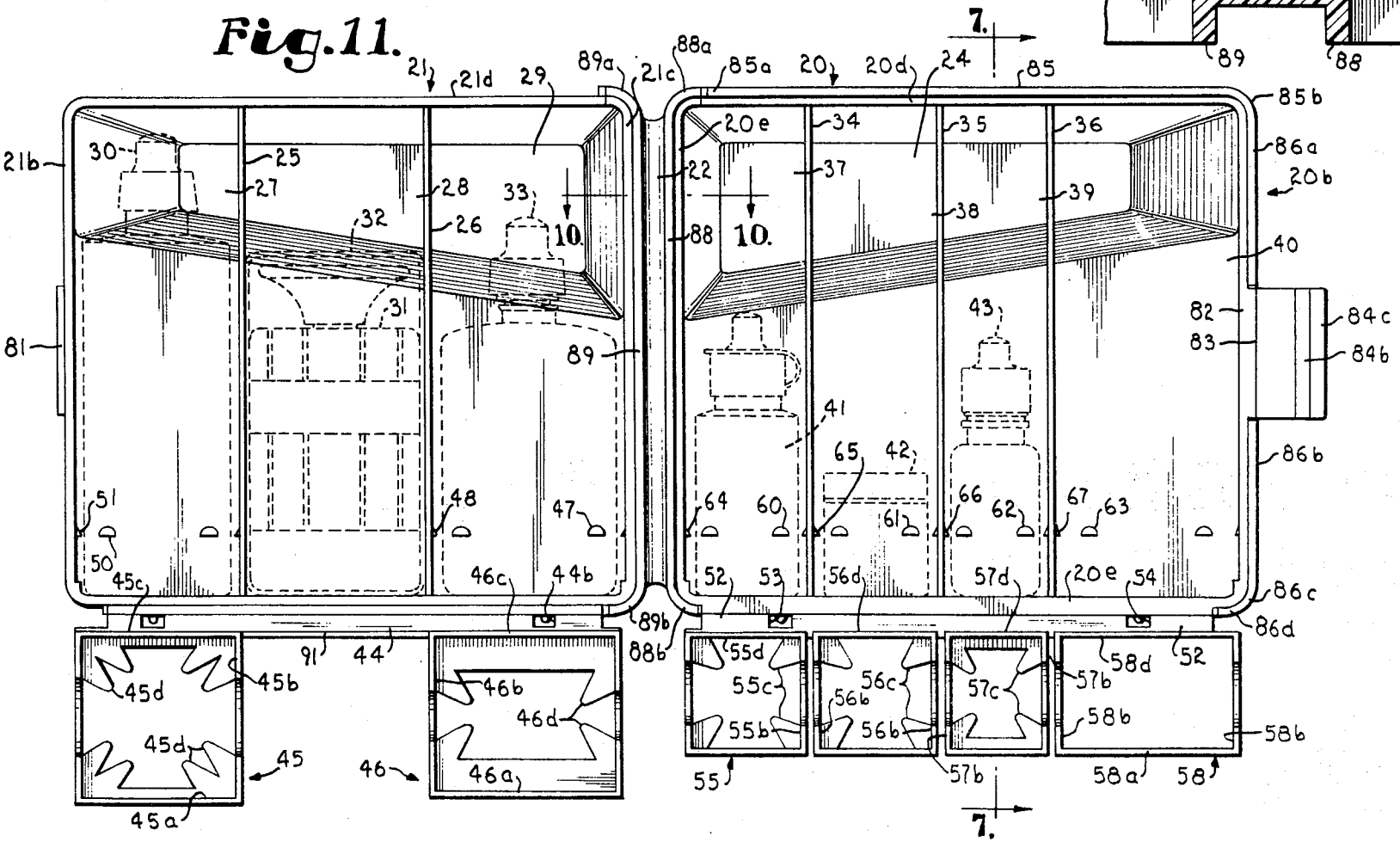

FIG. 7 is a view taken along the lines 7—7 of FIG. 11 in the direction of the arrows. (The dotted line showing in the lower portion of the view represents the true view along lines 7—7 in the direction of the arrows, the full line showing of the dotted line member rotated into position shows the construction assembled.

Figure 8:
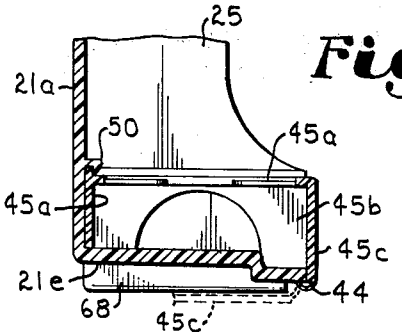

FIG. 8 is a view taken along the lines 8—8 of FIG. 11 in the direction of the arrows. Again, the dotted line showing is the true section on FIG. 11, the full line showing illustrates the retainer element roted 270° into place ready to receive container or receptacle.

Figure 9:
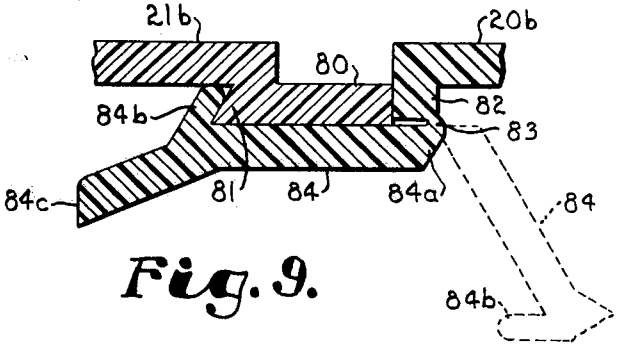

FIG. 9 is a view taken along the lines 9—9 of FIG. 3 in the direction of the arrows with the latch shown closed in full lines and open in dotted lines.

Figure 10:
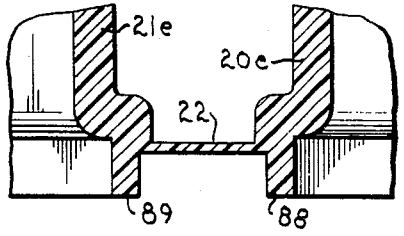

FIG. 10 is a view taken along the lines 10—10 of FIG. 11 in the direction of the arrows.

FIG. 11 is a front elevation of the subject case open with the compartment of both side receptical thereof facing toward the viewer. The hinge is centrally of the view with the latch element centered at the left and right hand sides. The retainer inserts and their hinges are rotated downwardly and out of engagement 270° so that a plan view of same is given on both sides. Additionally, in dotted lines, there are shown typical containers received by the device in use.

MINI-CASE DRAWINGS

FIGS. 12–18, inclusive, are directed to an optional mini-case which may be received within one cell or compartment of the accessory case of FIGS. 1–11, inclusive.

Figure 12:
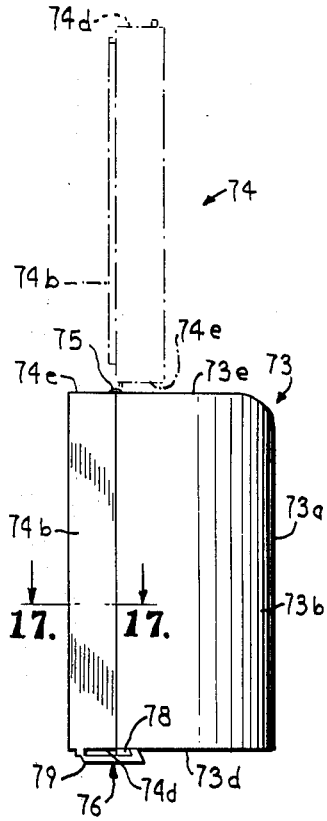

FIG. 12 is an end view of the mini-case with the lid to the left in the view and the latch at the bottom left thereof. The case is shown closed in full lines and with the lid pivoted around its hinge 180° to an open position in dotted lines.

Figure 13:
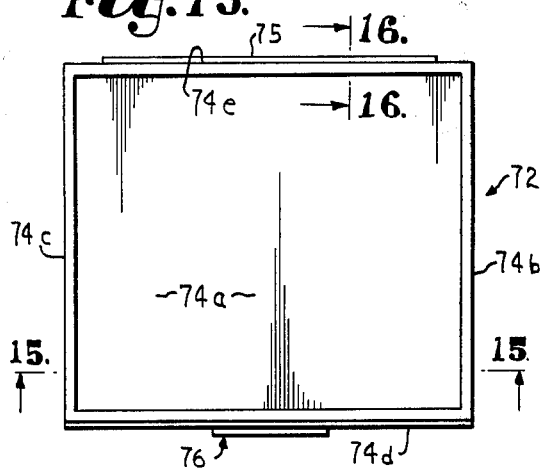

FIG. 13 is a plan view of the mini-case with the latch down and the hinge up looking from left to right in the view of FIG. 10.

Figure 14:
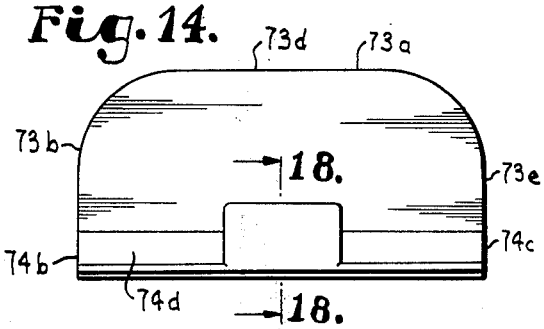

FIG. 14 is a view looking upwardly from below in FIG. 12 showing the mini-case in closed position (latch end).

Figure 15:
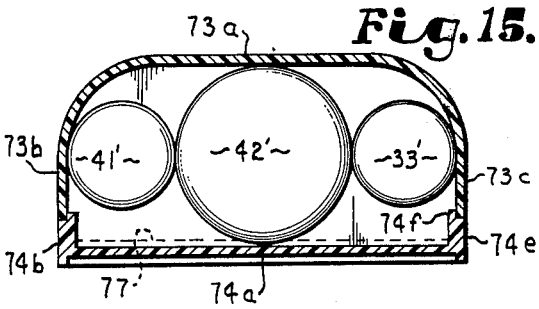

FIG. 15 is a view taken along the line 15—15 of FIG. 13 in the direction of the arrows showing the contents thereof.

Figure 16:
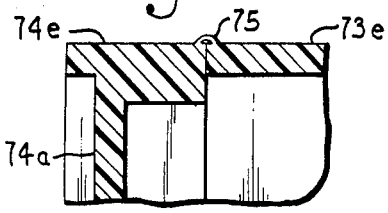

FIG. 16 is a view taken along the line 16—16 of FIG. 13 in the direction of the arrows (showing a detail of the hinge).

Figure 17:
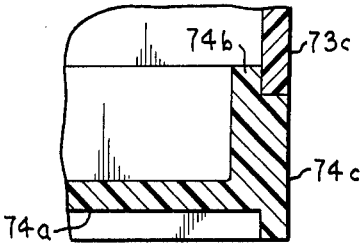

FIG. 17 is a view taken along the line 17—17 of FIG. 12 in the direction of the arrows (showing the edge lid closure).

Figure 18:
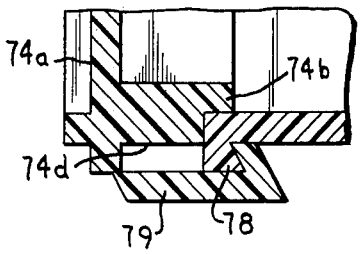

FIG. 18 is a view taken along the line 18—18 of FIG. 14 in the direction of the arrows (showing the latch construction).

STRUCTURE

Referring now to the drawings, and more particularly to FIGS. 1–11, inclusive, therein is shown the improved container particularly adapted for use as a contact lens accessory case. The case is made up of two receptacles generally designated 20 and 21, respectively, receptacle 20 being of lesser depth than receptacle 21, as will be described herebelow. Receptacles 20 and 21 are hinged to one another at one edge thereof by hinge 22. This container or case may be advantageously fabricated from plastic materials such as by injection molding of polypropylene all in one piece. In such manner the two configured receptacles, with integral hinge, latch members, inner walls defining the desired compartmentation, and retainers within the latter, may be simultaneously formed.

Receptacle 21 has side panel 21*a*, normally vertical end panels 21*b* (at the latch end) and 21*c* (at the hinge end). Receptacle 21 additionally has top panel 21*d* and bottom wall or panel 21*e*. Integrally molded into panel 21*a* or otherwise formed therein is an elongate, indented hand grip 23. Grip 23 is adapted to receive therewithin either the thumb or fingers of either hand (one or the other) and cooperates with a like grip on the side panel of receptacle 20 to be described. The configuration of the grip 23 panel indentation in the side panel 21*a* of receptacle 21 is preferably as illustrated, namely, tapering from a greater to a lesser heights from the hinge toward the latch. Receptacle 21 is of greater depth than receptacle 20.

For receptacle 20, same has side panel 20*a*, fastener or latch carrying end panel 20*b*, hinge end panel 20*c*, top wall or panel 20*d* and bottom wall or panel 20*e*. As in the case of side panel 20*a* of receptacle 20 has an elongate dished or indented handle or grasping means or grip 24. This preferably runs from hinge end panel 20*c* to latch end panel 20*b* and, like grip indentation 23, preferably is of lesser height adjacent latch end panel 20*b*, tapering to a greater height adjacent the hinge end panel 20*b*, tapering to a greater height adjacent the hinge end of the side panel 20*a*. Receptacle 20 is of lesser depth than receptacle 21. Referring first to the greater depth receptacle 21, particularly as seen in FIG. 11, same is divided by a pair of elongate walls 25 and 26 into separate chambers 27, 28 and 29, respectively.

For a specific example, it will be assumed that chamber or compartment 27 is to receive a typical four ounce (fluid) container of contact lens soaking solution, as seen in dotted lines at 30. In the same specific example, the chamber 28, then, is so sized as to receive a typical contact lens washing machine shown in dotted lines at 31. Yet further, there is shown in chamber 28, also removably containing the contact lens washing machine, a water tray numbered 32. Finally, in this specific example, the chamber or compartment 29 is seen (in dotted lines) as receiving a typical commercial container for a contact lens wetting solution adapted to carry or hold two fluid ounces as at 33.

Without restricting oneself to particular numbers, typical dimensions in receptacle 21 would be a total inside width of 6.492 inches dividing into chambers of 1.881 inches (27), 2.043 inches (28) and 2.443 inches (29). The inside height of the compartments then would be 5.718 inches.

On the other hand, again referring to the specific example of a contact lens accessory kit, in receptacle 20 there are provided walls or dividers 34, 35 and 36 in this lesser depth receptacle. These walls define with the end walls 20*b* and 20*c* chambers or compartments 37, 38, 39 and 40. In the arrangement shown, chamber 37 is adapted to receive a typical commercial container of contact lens cleaner to be used in the washing machine 31 or the water tray 32 as seen in dotted lines at 41. Chamber or or compartment 38, then, may receive, as seen at 42 in dotted lines, a typical commercial contact lens storage case. Compartment or chamber 39 is seen (in dotted lines) as receiving at 43 a commercially available container of eye decongestant (15cc typical).

Again looking at a specific example, but not being limited with respect to the numbers recited, if the total inside dimension between walls 20*b* and 20*c* is 6.492 inches, then a width of 1.359 inches for chamber 37, 1.359 inches for chamber 38, 1.197 inches for chamber 39 and 2.377 inches for chamber 40 has proved to be workable and adequate for the items and devices mentioned. Chamber 40 may receive either conventional eye glasses in the retainer to be named or the mini-case yet to be described.

Now referring particularly to FIGS. 2, 7, 8 and 11, therein may be seen the container and receptacle retainer means which fit into certain of the compartments to receive the particular containers and devices heretofore recited and removably retain same in fixed position for transport and storage. First looking at the deeper receptacle 21, an elongate resilient tab 44 relieved as at 44*a* and 44*b* operates as a hinge for connection to a pair of generally rectangular (in the view of FIG. 11) frames 45 and 46. The view of FIG. 11 includes a bottom plan view of frames 45 and 46.

In frame 46, relatively short wall 46*a* is provided operative to be received under rear retainer lugs 47. Side wall portions 46*b* snap under (at the sides thereof) retainer lugs 48.

Likewise, wall 45*a* of frame 45 will snap under lugs 50, while the side wall portions 45*b* will lock under side lugs 51.

In the case of each of frames 45 and 46, there may be provided resilient retainer fingers 45*d* and 46*d*, respectively.

Thus, referring only to receptacle 21, first, it may be seen that the two retainer frames 45 and 46 may be emplaced by rotating the frames 45 and 46 around the hinge 44 270° from the position of FIGS. 11 and 8 (in the view of FIG. 8 counterclockwise). The frames lock or snap under the lugs 50 and 51 (frame 45) and 47 and 48 (frame 46). There is no retainer frame provided for chamber 28.

Referring, then, to receptacle 20, there is a hinge 52 relieved as at 53 and 54 to which is attached four frames, namely, 55, 56, 57 and 58 fitting into (removably) chambers or compartments 37–40, inclusive, respectively. Each of these frames 55–57, inclusive, have the short wall portions 55*a*–57*a*, inclusive, which snap under lugs 60–63, inclusive. Likewise, they have side wall portions 55*b*–57*b*, inclusive, which removably snap under lugs 63–67, inclusive, the latter paired on the facing side walls of the compartments 37–39, inclusive. The larger end frame 58 is a simple rectangular wall open frame retainer member which removably snaps under lugs 63 and 67. The frames 55–57, inclusive, also may have resilient container or device retainer fingers 55*c*–57*c*, inclusive.

Referring now to the underside of the case and, particularly, the receptacles 20 and 21, one turns to FIG. 4. Therein, it may be seen that on bottom wall 21*e* there are provided spaced, parallel ridges or rests 68 and 69. These run at substantially right angles to the edge of wall 21*e* which abuts the edge of wall 20*e*. Likewise, on bottom wall 20*e*, there are provided a pair of spaced ridges or rests 70 and 71 oriented like ridges 68 and 69 on bottom wall 21*e* so that, when the container or case is closed as seen in FIG. 4, ridges 68 and 70 are axially in line with one another, as are ridges or rests 69 and 71.

Now referring to FIGS. 12–18, inclusive, therein is shown a mini-case which may be employed alone or in conjunction with the main case. It is so sized as to be receivable within the compartment 40 (in lieu of a glasses case or a pair of glasses). Typically, the mini-case may be removed from the main case and carried in the pocket of a man or the handbag of a woman.

The mini-case, basically numbered 72, per se, has a receptacle body generally designated 73, to one side of which is hinged a lid generally designated 74, the hinge itself 75. A latch generally designated 76 is also provided.

Typically, the mini-case will receive a mirror removably within the lid thereof. The body portinn 73, having rounded side edges and preferably at least one end thereof also rounded, functions as a water tray analogous to tray 32. Any desired multiple of the accessories recited previously (and solution containers) previously noted with respect to the main case may be carried which will fit. Optimally however, a contact lens storage case 42′ as well as a container of contact lens soaking solution 41′ and a container of contact lens wetting solution 33′ may be included.

Referring, then, to the body portion 73 of the mini-case, same has a bottom wall portion 73*a*, side walls 73*b* and 73*c* and end walls 73*d* and 73*e*.

The lid 74 has a top wall 74*a*, side walls 74*b* and 74*c* and end walls 74*d* and 74*e*. The mirror, removably receivable within the top 74, is indicated at 77. A circumferential flange 74*f* is provided inwardly of the walls 74*b–e*, inclusive, to sealingly engage the end edges of the walls 73*b–e*, inclusive, of the mini-case body.

Referring now to the latch generally designated 76, a flange 78 is provided on wall 73*d* centrally thereof whereby to be engaged by latch member 79 as best seen in FIGS. 10 and 16.

The entire mini-case, as seen in FIGS. 10–16, inclusive, may be injection molded as a unit with the parts described of polypropylene or the like.

There remains the description of the circumferential edge engagement of the two halves (receptacles, shells) of the container, the snap lock and the flange on the shallower shell top and latch end edges.

Turning first to the latch or snap lock, same is seen in FIGS. 1–5, inclusive, 9 and 11. FIG. 9 has the most detailed view and will be used in the description.

Wall 21*b* of greater depth shell 21 has outwardly angled flange member 80 molded integrally therewith, same having angled engaging edge 81. The adjacent wall 20*b* (when the case is closed as in FIGS. 2–4, inclusive) has a portion 82 thereof molded or formed at right angles to wall 20*b* carrying resilient hinge 83. The latch body 84 is connected to hinge 83 at end 84*a* thereof and has engaging tongue 84*b* and finger or thumb flange 84*c* at the other end thereof.

In operation of the latch, when same is in closed or locked position as in FIGS. 1–5, inclusive and 9, the user of the case merely inserts the end of his thumb between flange 84*c* and wall 21*b* and pries engaging tongue 84*b* over engaging edge 81. Body 84 is resilient plastic and can bend, same being true of edge 81. Thus, the action is counterclockwise in FIG. 9 from full to dotted line positions. Reversal of this action relocks the case.

With respect to the flange which overlies portions of walls 21*d* and 21*b* and is attached to walls 20*d* and 20*b*, same is seen in the views of FIGS. 1–4, inclusive, 5, 7 (particularly) and 11. The upper portion 85 thereof begins at 85*a* and runs along the entire upper wall 20*d* until it curves over and downwardly at 85*b* where wall 20*d* meets wall 20*b*. Its sectional configuration is seen in FIG. 7.

The portion of the flange on the front wall 20*b* of the smaller shell is numbered 86 and has three parts. They comprise upper portion 86*a* above the latch structure, 86*b* therebelow and 86*c* making the corner turn to wall 20*e*. The latter portion ends at 86*d*. The sectional configuration of the attachment of flange portions 86*a* and 86*b* with respect to wall 20*b* is that of FIG. 7 at 85 and 20*d*.

Turning to the four wall junctures (20*c* and 21*c* in FIG. 6; 20*d* and 21*d* in FIG. 2; 21*e* and 20*e* in FIG. 4 and 20*b* and 21*b* in FIG. 3) when the case is closed, the following is noted.

Looking first at FIGS. 6, 10 and 11, it is first noted that walls 20*c* and 21*c* are of equal depth or width and are congruent though opposed. Thus, seam 87 is on the center line of the box or container. This is true only of these two walls of the container.

The juncture of surfaces 88 and 89 on the hinge ends of walls 20*c* and 21*c* forms the closure seam 87 of the hinge carrying walls 20*c* and 21*c*. Surfaces 88 and 89 turn the upper and lower corners as at 88*a* and 89*a* and 88*b* and 89*b*. This ends the equal depth wall sections.

Particularly referring to FIGS. 4, 7 and 8 (also see FIG. 6), the abutting closure juncture of the bottom or lower walls 20*e* and 21*e* results in the seam 90. The snap in retainers pivot around 270° hinges 44 and 52 to the positions of FIGS. 7 and 8. The walls 45*c* and 46*c*, which are part of a continuous member 91, abut in facing relation with the like continuous wall which makes up the walls 55*d*–58*d*, inclusive.

The line of the seam 90 is displaced laterally from the abutments of the latch end walls 20*b* and 21*b* and the top walls 20*d* and 21*d*. It is also laterally displaced from seam 87. Such lateral displacement may be seen in FIGS. 2–4, inclusive and 6.

The greater depth portions of wall 21*e* run from 21*e*′ to 21*e*″ from the hinge end to the latch end (FIG. 4).

The walls 21*b* and 20*b* abut with the former sliding under flange portions 86*a–d*, inclusive in the manner of FIG. 7 juncture.

The device comprises a two-sided container, each side of the container acting as a receiver or well for a plurality of objects to be carried thereby.

The device is adapted for use standing on its lower edge and opening around a central vertical hinge like book.

A plurality of walled, spaced recesses are provided in each receiver or well.

One of the container sides or wells is of lesser depth than the other and receives smaller containers and a glasses case.

The other container side or well is deeper and received larger containers and a washing tray, as well as a mirror.

Retainers for two containers in two of the recesses in the deeper container side are provided, and, as well, for three containers and a glasses case in the shallower side. These retainers are removable from the recesses and snap therewithin.

A snap lock is provided to engage the vertical edges opposite the vertical hinged side.

The snap lock includes a pivotal member on the shallower side which overlies and engages a flange on the end of the deeper side.

There is provided on the upper side and edge of the lesser depth side carrying the snap lock, a protective and overlying flange which disguises from the user the fact that the case is asymmetrical.

The central hinge on the back vertical edge (the snap lock and its receiver being on the front vertical edge) is in the center of the case or centered on the case. That is, the back well depth in the two sides, wells or receivers are equal in depth.

The side protective and overlying flange is interrupted by the snap latch on the front edge.

The edge engagement of the two sides has the following parts:

1. The hinge side or back edge (vertical in use);
2. The bottom edge;
3. The top edge;
4. The front edges;
5. Transitions between each of the same.

The entire container, including the two sides thereof, the walls in each of same defining the recesses thereof, the retainers which fit into the recesses, the locking means and the resilient hinge web connecting the ends of the shells may all be integrally molded or case as a unit. (preferably injection molded)

From the foregoing, it will be seen that this invention is one well adapted to attain all of the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

Having thus described my invention, I claim:

1. A multi-compartment case for carrying, removably retaining and displaying a plurality of containers therein in vertical orientation comprising, in combination:

1. a first substantially rectangular receptacle having a side wall, substantially parallel end walls and substantially parallel top and bottom walls,
2. a second substantially rectangular receptacle having a side wall, substantially parallel end walls and substantially parallel top and bottom walls,
3. said receptacles having a width at least equal to the height thereof, as well as being congruent in form and equal in open face area,
4. base support means on said receptacle bottom walls operative to mount said case as a standing, self-supporting unit in both closed and open positions, normally erect on the bottom walls of the receptacles,
5. normally vertical hinge means joining in flexible fashion the free edges of one end wall of each of said receptacles, whereby same may be moved together and apart in a normally horizontal plane around said hinge to form closed a standing, self-supporting, integral closed container and when open a pair of standing, self-supporting, angled apart, open-face receptacles, respectively,
6. normally vertical latch means cooperatively mounted on each of the other end walls of said receptacle operative to engage one another and form said standing integral closed container when said receptacles are pivoted to closed position around said hinge,
7. at least two elongate normally vertical partitions provided within each of said receptacles fastened along their entire length to the inside face of the respective receptacle side wall, same running between and connecting at their upper and lower ends to the top and bottom walls thereof and further running substantially parallel to the receptacle end walls, thereby to define in each said receptacle at least three parallel, substantially rectangular, normally vertical storage chambers of substantially greater height than width, when said receptacles are standing normally erect on the bottom walls thereof,
8. limited, fixed wall means associated only with the normally lowermost part of at least two of said storage chambers in each receptacle operative to removably retain objects received in each of said chambers in the normal vertical standing position of the case by closing off only the lowermost portions of the open fronts of said storage chambers, while permitting ready insertion and removal of such objects without moving said wall,
9. each said latter wall means made up of an assembly comprising at least a front wall member, a top wall member and a back wall member, the said front wall member hingedly connected to the bottom wall of one receptacle and the top wall member thereof being open centrally, whereby said assembly, before use of the case, is pivoted around said hinge into position in the lower end of its corresponding compartment with the front and back wall members normally vertical, the top wall member normally horizontal and the assembly retained in this position in its compartment by lugs on a wall of the compartment overlying one wall of the assembly,
10. the entire, normally uppermost portions of the side walls of each of said receptacles tapering upwardly toward one another when said case is closed, and
11. a normally horizontal elongate grasping indentation or recess provided in each of the upper tapered portions of the side wall of each said receptacle adjacent the upper edge thereof,
12. each said recess running substantially the length of the said side wall,
13. said recesses serving, in combination, when the case is closed, as a normally horizontal grasping and carrying handle for the case, so that said case is normally carried with the storage chambers thereof in vertical orientation.

2. A multi-compartment case for carrying, removably retaining and displaying a plurality of containers therein in vertical orientation comprising, in combination:

1. a first substantially rectangular receptacle having a side wall, substantially parallel end walls and substantially parallel top and bottom walls, 2. a second substantially rectangular receptacle having a side wall, substantially parallel end walls and substantially parallel top and bottom walls,
3. said receptacles having a width at least equal to the height thereof, as well as being congruent in form and equal in open face area,
4. base support means on said receptacle bottom walls operative to mount said case as a standing, self-supporting unit in both closed and open positions, normally erect on the bottom walls of the receptacles,
5. normally vertical hinge means joining in flexible fashion the free edges of one end wall of each of said receptacles, whereby same may be moved together and apart in a normally horizontal plane around said hinge to form closed a standing, self-supporting, integral closed container and when open a pair of standing, self-supporting, angled apart, open-face receptacles, respectively,
6. normally vertical latch means cooperatively mounted on each of the other end walls of said receptacle operative to engage one another and form said standing integral closed container when said receptacles are pivoted to closed position around said hinge,
7. at least two elongate normally vertical partitions provided within each of said receptacles fastened along their entire length to the inside face of the respective receptacle side wall, same running between and connecting at their upper and lower ends to the top and bottom walls thereof and further running substantially parallel to the receptacle end walls, thereby to define in each said receptacle at least three parallel, substantially rectangular, normally vertical storage chambers of substantially greater height than width, when said receptacles are standing normally erect on the bottom walls thereof,
8. limited, fixed wall means associated only with the normally lowermost part of at least two of said storage chambers in each receptacle operative to removably retain objects received in each of said chambers in the normal vertical standing position of the case by closing off only the lowermost portions of the open fronts of said storage chambers, while permitting ready insertion and removal of such objects without moving said wall,
9. each said latter wall means made up of an assembly comprising at least a front wall member, a top wall member and a back wall member, the said front wall member hingedly connected to the bottom wall of one receptacle and the top wall member thereof being open centrally, whereby said assembly, before use of the case, is pivoted around said hinge into position in the lower end of its corresponding compartment with the front and back wall members normally vertical, the top wall member normally horizontal and the assembly retained in this position in its compartment by lugs on a wall of the compartment overlying one wall of the assembly,
10. the depth of one of said receptacles being substantially less than the depth of other said receptacle and there being at least one less partition in the greater depth receptacle, whereby most of the storage compartments therein are of greater size than most of the storage compartments in the lesser depth receptacle, and
11. flange means attached to the top wall and latch end wall of the lesser depth receptacles, which flange means overlies a portion of the top wall and latch end wall of said greater depth receptacle in closure of the case, thereby to overlie and protect the line of closure of said receptacles, the width of said flange substantially equal to the excess of depth of the one receptacle over the other,
12. the entire, normally uppermost portions of the side walls of each of said receptacles tapering upwardly toward one another when said case is closed, and
13. a normally horizontal elongate grasping recess provided in each of the upper tapered portions of the side wall of each said receptacle adjacent the upper edge thereof,
14. each said recess running substantially the length of the said side wall,
15. said recesses serving, in combination, when the case is closed, as a normally horizontal grasping and carrying handle for the case, so that said case is normally carried with the storage chambers thereof in vertical orientation.

3. A multi-compartment case for carrying, removably retaining and displaying a plurality of containers therein in vertical orientation comprising, in combination:

1. a first substantially rectangular receptacle having a side wall, substantially parallel end walls and substantially parallel top and bottom walls,
2. a second substantially rectangular receptacle having a side wall, substantially parallel end walls and substantially parallel top and bottom walls,
3. said receptacles having a width at least equal to the height thereof, as well as being congruent in form and equal in open face area,
4. base support means on said receptacle bottom walls operative to mount said case as a standing, self-supporting unit in both closed and open positions, normally erect on the bottom walls of the receptacles,
5. normally vertical hinge means joining in flexible fashion the free edges of one end wall of each of said receptacles, whereby same may be moved together and apart in a normally horizontal plane around said hinge to form closed a standing, self-supporting, integral closed container and when open a pair of standing, self-supporting, angled apart, open-face receptacles, respectively,
6. normally vertical latch means cooperatively mounted on each of the other end walls of said receptacle operative to engage one another and form said standing integral closed container when said receptacles are pivoted to closed position around said hinge,
7. at least two elongate normally vertical partitions provided within each of said receptacles fastened along their entire length to the inside face of the respective receptacle side wall, same running between and connecting at their upper and lower ends to the top and bottom walls thereof and further running substantially parallel to the receptacle end walls, thereby to define in each said receptacle at least three parallel, substantially rectangular, normally vertical storage chambers of substantially greater height than width, when said receptacles are standing normally erect on the bottom walls thereof, 8. limited, fixed wall means associated only with the normally lowermost part of at least two of said storage chambers in each receptacle operative to removably retain objects received in each of said chambers in the normal vertical standing position of the case by closing off only the lowermost portions of the open fronts of said storage chambers, while permitting ready insertion and removal of such objects without moving said wall, 9. each said latter wall means made up of an assembly comprising at least a front wall member, a top wall member and a back wall member, the said front wall member hingedly connected to the bottom wall of one receptacle and the top wall member thereof being open centrally, whereby said assembly, before use of the case, is pivoted around said hinge into position in the lower end of its corresponding compartment with the front and back wall members normally vertical, the top wall member normally horizontal and the assembly retained in this position in its compartment by lugs on a wall of the compartment overlying one wall of the assembly, 10. the depth of one of said receptacles being substantially less than the depth of other said receptacle, and 11. flange means attached to the top wall and latch end wall of the lesser depth receptacle, which flange means overlies a portion of the top wall and latch end wall of said greater depth receptacle in closure of the case, whereby to overlie and protect the line of closure of said receptacles the width of said flange substantially equal to the excess of depth of the one receptacle over the other, and 12. separate horizontal handle means integral with the uppermost portions of the side wall of each said receptacle cooperating with one another when the case is closed to enable the case user to grasp with one hand the top of the case and carry same in its normally erect orientation.

* * * * *